United States Patent [19]

Lübbers

[11] Patent Number: 4,762,068

[45] Date of Patent: Aug. 9, 1988

[54] CARTRIDGE-TYPE AMMUNITION

[75] Inventor: Willi Lübbers, Trittau, Fed. Rep. of Germany

[73] Assignee: Nico-Pyrotechnik Hanns-Jürgen Diederichs GmbH & Co KG, Trittau, Fed. Rep. of Germany

[21] Appl. No.: 948,359

[22] PCT Filed: Feb. 25, 1986

[86] PCT No.: PCT/EP86/00097

§ 371 Date: Nov. 5, 1986

§ 102(e) Date: Nov. 5, 1986

[87] PCT Pub. No.: WO86/05265

PCT Pub. Date: Sep. 12, 1986

[30] Foreign Application Priority Data

Mar. 5, 1985 [DE] Fed. Rep. of Germany ..... 3507643

[51] Int. Cl.[4] ..... F42B 5/02

[52] U.S. Cl. ..... 102/439; 102/334; 102/430; 102/470; 102/513

[58] Field of Search ..... 102/334, 346, 364, 365, 102/367–369, 336, 374, 376, 380, 430, 434, 439, 443, 464, 466, 467, 469, 470, 472, 513

[56] References Cited

U.S. PATENT DOCUMENTS

| | | | |
|---|---|---|---|
| 2,872,864 | 2/1959 | Barnes et al. | 102/439 |
| 3,547,030 | 12/1970 | Kamp et al. | 102/434 |
| 3,981,241 | 9/1976 | Ambrosini et al. | 102/346 |
| 4,197,801 | 4/1980 | Lafever et al. | 102/433 |

FOREIGN PATENT DOCUMENTS

| | | |
|---|---|---|
| 2262981 | 6/1980 | Fed. Rep. of Germany . |
| 3149430A1 | 4/1982 | Fed. Rep. of Germany . |
| 1566410 | 5/1969 | France . |
| 79338 | 1/1938 | Sweden . |

*Primary Examiner*—Harold J. Tudor

[57] ABSTRACT

Cartridged ammunition 1 for a grenade pistol includes a casing 10 made, for example, of plastic, the casing having an opening. A projectile 11 is disposed in the casing opening and includes a tracer charge and/or delayed-action charge 11*b*. A primer 13 and a propelling charge 14 are disposed in a cup 12 at the base of casing 10. The cup 12 is composed of two mutually concentric sleeves 12*a* and 12*b*, with the inner sleeve 12*b* being mounted so as to be slidable in the outer sleeve 12*a* and extendable in the manner of a telescope. The outer sleeve 12*a* has a free end section which is provided with an external thread 100 followed by an annular, predetermined, circumferential break location 12*d*. The base of projectile 11 includes a sleeve 17 provided with an internal thread which can be screwed onto the outer sleeve 12*a* of cup 12. A firing channel 12*c* is provided in the bottom or endwall 12*e* of the cup-shaped inner sleeve 12*b*, with such firing channel being oriented toward the tracer and/or delayed-action charge 11*b*. The result of this construction is that the ammunition can be assembled easily, and an almost constant initial velocity can be maintained despite fluctuating environmental conditions.

13 Claims, 2 Drawing Sheets

CARTRIDGE-TYPE AMMUNITION

BACKGROUND OF THE INVENTION

The invention relates to cartridged ammunition for a grenade pistol, the ammunition being of the type that includes a casing having an opening, a projectile which is disposed in the opening and which includes a payload and a transfer charge (such as a tracer charge and/or a delayed-action charge) for the payload, and primer and propelling charges disposed in a cup at the base of the casing.

Cartridged ammunition for a grenade piston is disclosed in German Offenlegungs-Schrift (unexamined laid-open application) No. 3,149,430. The prior art ammunition includes a metal propelling charge container or casing (made, for example, of aluminum) with which the grenade body or the projectile is crimped together. Primer and propelling charges are disposed in a cup-shaped propelling charge cartridge which is screwed into the base of the casing. Radially extending discharge openings permit, after firing of the propelling charge, propagation of the propellant gases into the interior of the casing and charge the tail of the projectile with propellant gas pressure.

To save costs, the casing of cartridged practice ammunition is preferably made of plastic and, since crimping is then not possible, the casing must be connected with the generally metal projectile body by glue.

However, glue connections have the drawback that, in spite of careful matching and monitoring of all manufacturing parameters, even within one and the same lot, different degrees of extraction forces are observed. Additionally, the extraction force is a function of temperature and aging. Since, moreover, a considerably smaller propelling charge is employed for practice ammunition compared to combat ammunition, a particularly disadvantageous temperature dependency of the propellant gas pressure results when the propellant gases exit from the propelling charge cartridge or the propelling charge cup into the large-volume interior of the propelling charge casing. Both effects have the drawback of producing greatly deviating values for the initial velocity ($V_0$) of the projectile, and reproducible firing results are almost impossible to attain. In connection with prior art projectiles it was additionally noted that, due to the escape of propellant gases into the interior of the casing, the tracer or delayed-action charge disposed in the tail section of the projectile is not fired with sufficient reliability.

SUMMARY OF THE INVENTION

It is an object of the invention to improve cartridged ammunition for a grenade pistol to the extent that the above-described drawbacks are avoided and, primarily because of a constant, almost temperature independent initial velocity, firing results are realized which are reproducible over a broad temperature range as well as reliable ignition of the tracer and/or delayed-action charge.

Based on cartridged ammunition of the above defined type, this is accomplished by providing the cup which accommodates the priming and propelling charges in the form of two mutually concentric sleeves, with the inner sleeve being mounted in the outer sleeve so as to be slidable and extendable in the manner of a telescope. The inner sleeve is cup-shaped and is provided, in its bottom, with a firing channel oriented toward the tracer charge and the delayed-action charge. The outer sleeve has a free end section which is provided with an external thread followed by an annular, circumferential predetermined break location. The base of the projectile includes a sleeve having an internal thread which is screwed onto the outer sleeve of the cup.

DESCRIPTION OF THE PREFERRED EMBODIMENTS

Figure 1:
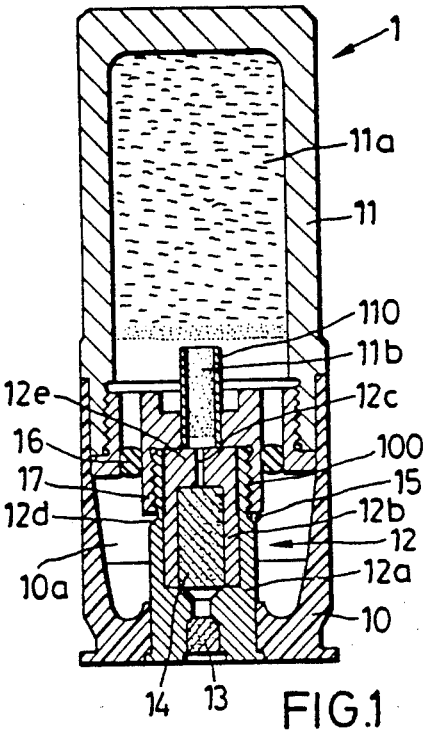
FIG. 1 is a view in longitudinal section illustrating the ammunition in its rest or un-fired state.

FIG. 1 is a longitudinal sectional view of a cartridged ammunition for a grenade pistol, for example having a caliber of 40 mm. Ammunition 1 includes a casing 10 made, for example, of plastic, with a projectile 11 being disposed in its opening. The projectile is equipped, for example, with a smoke charge 11*a* and a tracer charge and/or delayed-action charge 11*b* disposed in the tail section of projectile 11. A primer 13 and a propelling charge 14 are accomodated in a cup 12 disposed at the base of casing 10. Cup 12 is composed of two mutually concentrically arranged sleeves 12*a* and 12*b*. Inner sleeve 12*b* is cup-shaped and is mounted so as to slide in outer sleeve 12*a* and to be extended in a telescoping manner. The inner sleeve 12*b* is provided in its bottom or end wall 12*e* with a firing channel 12*c* oriented toward the tracer and/or delayed-action charge 11*b* in the tail section of projectile 11.

The free end section of outer sleeve 12*a* extends into the interior of 10*a* of casing 10 and is provided with an external thread 100 followed by an annular, circumferential predetermied break location 12*d*. The base of projectile 11 is provided with a sleeve 17 provided with an internal thread so that it can be screwed onto outer sleeve 12*a* of cup 12.

Due to the above-described structure, the ammunition can be assembled in a particularly easy and economical manner. After inserting cup 12 containing primer 13 and propelling charge 14 into the base of casing 10, an O-ring 15 is initially placed into the annular, circumferential, predetermined break location 12*d* in the outer jacket of outer sleeve 12*a* of cup 12. Then, projectile 11 is screwded by means of sleeve 17 onto external thread 100 of cup 12 until casing 10 and projectile 11 are seated flush on top of one another. Thus there is no gluing of the plastic casing 10 to projectile 11, so that all the above-described drawbacks connected with glue connections are avoided. If a metal casing is employed, crimping is no longer necessary. The O-ring 15 placed into predetermined break location 12*d* reliably seals the screw connection against any moisture that might still reach the interior 10*a* of casing 10, so that the cartridged ammunition remains reliably operational even after very long periods of storage.

The functioning of the ammunition will be described with reference to FIGS. 2 and 3. After the firing of propelling charge 14 by way of primer 13, a gas pressure develops in the propelling charge chamber in cup 12, which causes the annular predetermined, break location 12*d* thus stressed with tension to yield only after a predetermined and easily reproduced pressure level is reached.

After predetermined break location 12*d* has been torn apart, the propelling charge pressure causes projectile 11 to be accelerated and begins to push it out of propelling charge casing 10. However, the volume available for the propellant gases is enlarged only comparatively slightly since the cup-shaped inner sleeve 12*b* (which, as previously noted is slidably mounted so as to be extended in a telescope-like manner in outer sleeve 12*a* of cup 12) is pressed out of outer sleeve 12*a* in a telescope-like manner when it participates in the movement of the projectile. This limits the volume of the propellant gas and prevents escape of propellant gases into the interior 10*a* of casing 10. Only after projectile 11 leaves the cartridge base—as shown in FIG. 3—and enters the rifling of the gun barrel (not shown), practically at its final velocity, will inner sleeve 12*b*, which is now completely separated from outer sleeve 12*a*, open a path for the propellant gases to enter into the interior 10*a* of casing 10. Due to the very tightly limited small volume in which the propellant gases are initially able to propagate, there results, in an advantageous manner, a greatly reduced temperature dependence of the propellant gas pressure which again, in spite of greatly differing ambient temperatures, leads to a constant initial velocity for projectile 11 and thus to reproducible firing results.

Limiting the propellant gas volume to a volume that is small initially is known per se from German Auslegeschrift (examined laid-open application) No. 2,262,981. However, in that publication, a ductile cup is provided in a disadvantageous manner to delimit the propelling charge chamber which, under the influence of the propellant gases, must be bulged out by deformation forces.

The firing channel 12*c* in the end wall 12*e* of cup-shaped inner sleeve 12*b* oriented toward the tracer and/or delayed-action charge 11*b* disposed in the tail section of projectile 11. Immediately after firing of propelling charge 14, hot propellant gases are thus able to pass through this firing channel 12*c*. This permits—in contrast to conventional ammunition—a completely reliable firing of the tracer and/or delayed-action charge 11*b*.

Tracer and/or delayed-action charge 11*b* simultaneously serves to provide for firing, possibly with a time delay, of a payload transported in projectile 11, here, for example, a smoke charge 11*a*. For this purpose, casing 110 which accommodates the tracer and/or delayed-action charge 11*b* is pyrotechnically coupled with the smoke charge 11*a* in such a manner that toward the end of the burning period of tracer and/or delayed-action charge 11*b*, smoke charge 11*a* is also fired. Thus pressure builds up in projectile 11 which, after causing an O-ring 16 to be blown off, permits clouds of smoke 19 to escape, as shown in FIG. 3, preferably through bores 18 uniformly distributed in an annular pattern. In this way, an effective smoke effect is produced even while the projectile 11 is in its last phase of flight, before it hits the ground. Instead of the smoke charge 11*a*, another payload, such as, for example, a flash, muzzle report, dye and/or fogging charge, may of course also be disposed in projectile 11.

Figure 4:
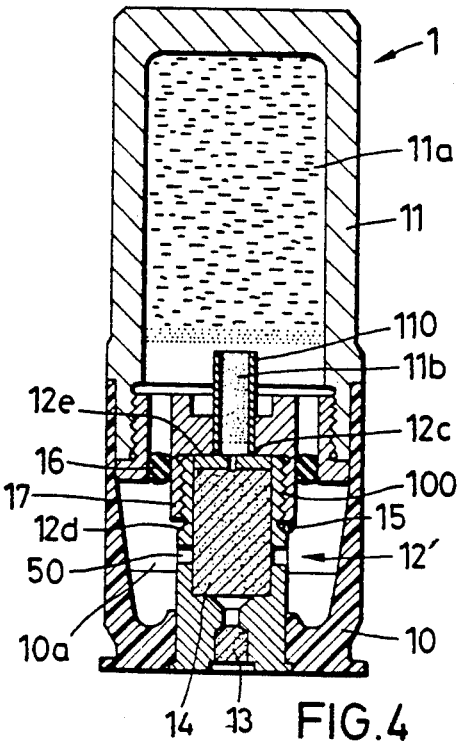
FIG. 4 is a view in longitudinal section illustrating a modified embodiment of the ammunition, with recesses provided in the sleeve of the cup.
Figure 5:
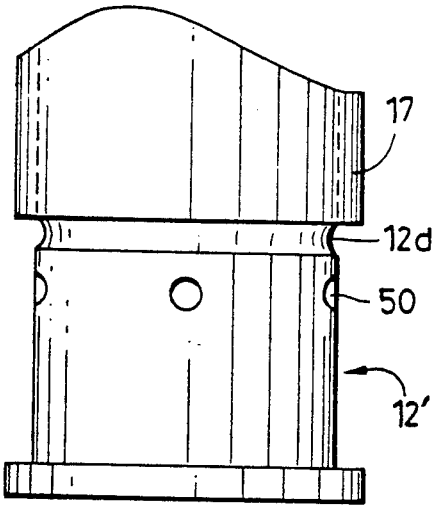
FIG. 5 is a side view of a portion of a sleeve illustrated in FIG. 4.
Figure 7:
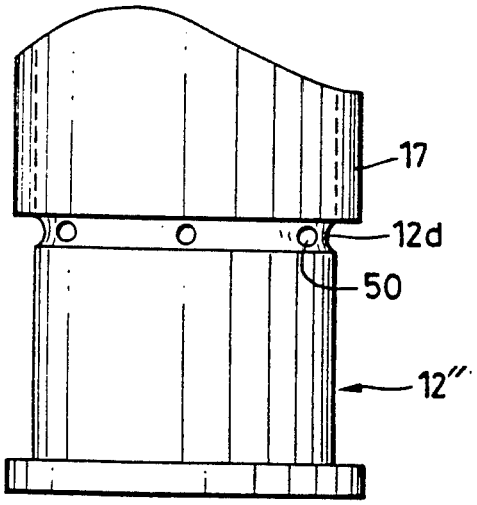
FIG. 7 is a side view of a portion of a sleeve in a further modified embodiment.
Figure 6:
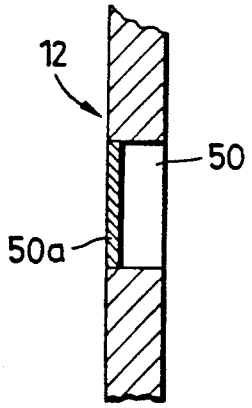
FIG. 6 is a sectional view through a portion of the sleeve of FIG. 5.

Advantageous modifications of the invention will be described with reference to FIGS. 4 to 7. FIG. 4 is a longitudinal sectional view of a practice cartridge, FIG. 5 is a side view of the cup 12' which is shown to a larger scale; FIG. 6 is a sectional view—again enlarged—through the wall of cup 12' in the region of recesses 50; and FIG. 7 is a side view of a cup 12' in another embodiment.

Figure 2:
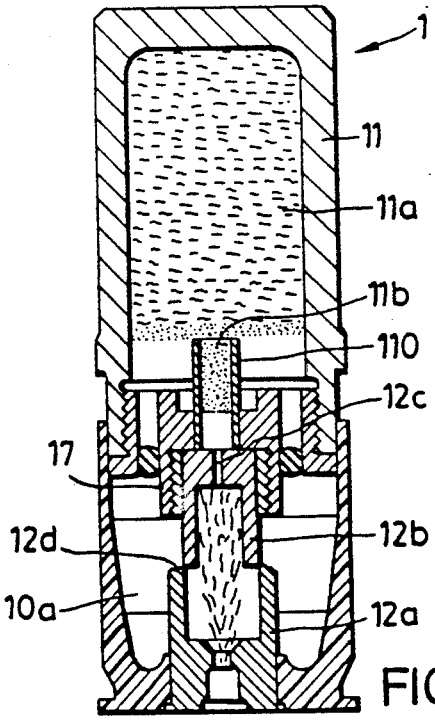
FIG. 2 is a view in longitudinal section illustrating the ammunition a short time after firing of the propelling charge.
Figure 3:
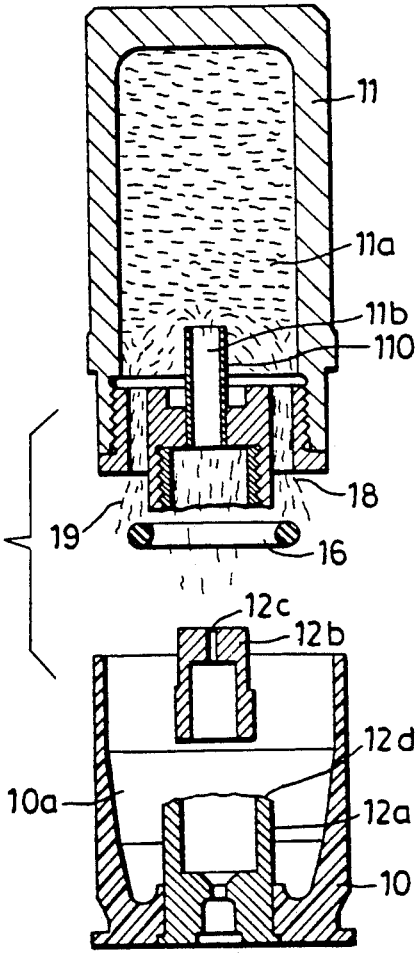
FIG. 3 is a view in longitudinal section illustrating the ammunition after separation of the projectile from the casing.

The advantageous modifications of the ammunition 1' differ from the embodiment according to FIGS. 1 to 3 primarily in that recesses 50 are provided in the wall of cup 12' so as to connect the chamber of propelling charge 14 with the interior 10*a* of casing 10. Each recess 50 may have a diameter between 0.5 mm and 2.5 mm, and preferably about 2 mm. These recesses 50 are preferably uniformly distributed in an annular pattern, in the embodiment according to FIG. 5 to 6, below predetermined break location 12*d*.

In one embodiment of the invention, four recesses 50 are provided at a mutual spacing of 90°. Due to the provision of recesses 50, after propelling charge 14 is fired the interior 10*a* of casing 10 is also charged with a gas pressure right from the beginning, albeit a lower gas pressure. In view of the large difference in volume between the propelling charge chamber within cup 12' and the interior 10*a* of casing 10, the pressure value encountered in interior 10*a* is lower, for example only 1/10 of the pressure in the interior of cup 12'. Since, however, projectile 11 delimits interior 10*a* of casing 10 with a relatively large surface area, a great force is exerted on projectile 11 in spite of the relatively low gas pressure in interior 10*a*, which force contributes to the separation between projectile 11 and casing 10.

In this modification of the invention, the predetermined break location 12*d* has such dimensions that it could not be destroyed merely on the basis of the propelling charge pressure developed in the interior of cup 12'. For example, predetermined break location 12*d* could be designed so that it would be destroyed only under a load of 750 kp. However, an internal pressure of about 400 bar in the interior of cup 12*a* and a surface area of about 1.25 $cm^2$ would develop only a force of about 500 kg. Only a combination of the forces acting on the projectile, due to the pressure in the interior of cup 12*a* and in the interior 10*a* of casing 10, makes it possible to destroy predetermined break location 12*d* and accelerate projectile 11. The contributing pressure in interior 10*a* of casing 10 is here about 50 bar, which exerts an additional force of 500 kp on the base surface of the projectile of about 10 $cm^2$. Thus, only the sum of the above mentioned force components exceeds the break resistance of predetermined break location 12*d*.

Due to the face that interior 10*a* is already preheated by the penetrated propellant gases and is charged with a certain pressure level, a significantly greater precision with respect to reproducibility of the initial velocity and range of projectile 11 can be realized.

In one embodiment of the invention, the outer diameter of casing 10 was about 38 mm, the inner diameter of cup 12' about 12 to 13 mm. Four recesses 50, each having a maximum diameter of about 2 mm, were disposed in cup 12' at mutual spacings of 90°. The weight of the projectile was about 180 g. With propellant charge 14 having a weight of about 0.35 g, a pressure of about 500 bar developed in the interior of cup 12', while about 1/10 of this pressure value, i.e. 50 bar, was noted in interior 10*a* of casing 10. After numerous test firings, a very uniform initial velocity was noted for projectile 11 and the range remained constant with a very low standard deviation, so that all requirements of the customer could be met. The spread in range was always below about 25 cm per 100 m, compared to about 45 cm per 100 m for conventional ammunition. The standard deviation of the initial velocity $V_o$ was always less than 1 m $sec^{-1}$. Thus the values required by the customer could be maintained without difficulty.

To improve the storage life of the cartridged ammunition and to make it less susceptible to moisture, it is advisable to cover recesses 50 with a membrane 50*a*—as shown in FIG. 6—which is not pressure resistant but is destroyed immediately after firing of propelling charge 14. This membrane 50*a* may be produced, for example, of a thin plastic or metal foil.

In a further embodiment of the invention, recesses 50 in cup 12' are advisably disposed so as to lie within annular, predetermined break location 12*d* (FIG. 7). This embodiment has the advantage that no separate cover is required for recesses 50, for example as shown in FIG. 6. Reliable sealing of recesses 50 is simultaneously effected by O-ring 15, which is inserted into the predetermined break location 12*d* so as to seal the screw connection between sleeve 17 and cup 12'.

What I claim is:

1. Cartridged ammunition for a grenade pistol, comprising:

a casing having an opening and a base;

a projectile disposed in the opening of the casing, the projectile including a payload, a base having a sleeve member with an internal thread, a transfer charge, and means for supporting the transfer charge adjacent the base of the projectile so that the transfer charge is disposed between the sleeve member and the payload and communicates with the payload;

primer and propelling charges; and cup means disposed at the base of the casing for accommodating the primer and propelling charges, the cup means including an outer sleeve having a first end and having a second end which is oriented toward the base of the casing, the outer sleeve additionally having an external thread adjacent the first end thereof and having an annular break location between the external thread and the second end, the external thread being screw-connected to the internal thread of the sleeve member, and an inner sleeve which is concentric with the outer sleeve, the inner sleeve being disposed in the outer sleeve so as to be telescopically slidable with respect thereto, the inner sleeve being generally cup-shaped and having an end which is oriented toward the transfer charge, the end of the inner sleeve having a firing channel.

2. Ammunition according to claim 1, wherein the casing is made of plastic.

3. Ammunition according to claim 1, wherein the transfer charge comprises a tracer charge.

4. Ammunition according to claim 1, wherein the transfer charge comprises a tracer charge and a delayed-action charge.

5. Ammunition according to claim 1, wherein the transfer charge comprises a delayed-action charge.

6. Ammunition according to claim 1, further comprising an O-ring disposed at the annular break location.

7. Ammunition according to claim 1, wherein the payload is a smoke charge, wherein the casing has an interior, and wherein the base of the projectile is provided with a plurality of bores which are uniformly distributed in a circular pattern and which communicate with the interior of the casing, and further comprising an O-ring to seal the bores from the interior of the casing during storage of the ammunition.

8. Ammunition according to claim 1, wherein the means for supporting the transfer charge comprises a sleeve element which is mounted on the base of the projectile and which has a pair of open ends, one end being directed toward the firing channel and the other end being directed toward the payload, the transfer charge being disposed in the sleeve element.

9. Cartridged ammunition for a grenade pistol, comprising:

a casing having an opening and a base;

a projectile disposed in the opening of the casing, the projectile including a payload, a base portion having a threaded region, a transfer charge, and means for supporting the transfer charge adjacent the base of the projectile and adjacent the payload, with the transfer charge communicating with the payload;

primer and propelling charges; and cup meas disposed at the base of the casing for accommodating the primer and propelling charges, the cup means including a cylindrical sleeve having a first end and having a second end which is mounted at the base of the casing, the cylindrical sleeve additionally having a threaded region adjacent the first end and having an annular break location between the second end and the threaded region, the threaded region of the cylindrical sleeve being screwed to the threaded region of the base portion of the projectile, and another cylindrical sleeve located in the cylindrical sleeve, the another cylindrical sleeve having an end which is directed toward the transfer charge, the cylindrical sleeve and another cylindrical sleeve being telescopically slidable with respect to each other.

10. Cartridged ammunition according to claim 9, wherein the base portion of the projectile comprises a sleeve member which extends toward the base of the casing, the threaded region of the base portion being provided on the sleeve member.

11. Cartridged ammunition according to claim 9, wherein the base portion of the projectile has a centrally disposed bore and wherein the means for supporting the transfer charge comprises a sleeve element mounted in the opening, the sleeve element having an end which is directed toward the another cylindrical sleeve and having another end which is directed toward the payload, the transfer charge being disposed in the sleeve element.

12. Cartridged ammunition according to claim 11, wherein the end of the another cylindrical sleeve that directed toward the transfer charge has an end wall with a firing channel therein.

13. Cartridged ammunition according to claim 9, wherein the cylindrical sleeve has a wall and the annular break location is provided by a groove in the wall.

* * * * *